US011196152B1

(12) United States Patent
Ryan et al.

(10) Patent No.: US 11,196,152 B1
(45) Date of Patent: Dec. 7, 2021

(54) METHOD AND SYSTEM FOR GENERATING AN OMNIDIRECTIONAL ANTENNA PATTERN FROM A DIRECTIONAL ANTENNA ARRAY

(71) Applicant: Avidyne Corporation, Melbourne, FL (US)

(72) Inventors: Dean Eric Ryan, Dublin, OH (US); Robert Michael Barts, Raleigh, NC (US); Lawrence Landis Ludwig, III, Melbourne, FL (US); Ross Edward Wakeman Hines, Melbourne, FL (US)

(73) Assignee: AVIDYNE CORPORATION, Melbourne, FL (US)

( * ) Notice: Subject to any disclaimer, the term of this patent is extended or adjusted under 35 U.S.C. 154(b) by 15 days.

(21) Appl. No.: 16/879,710

(22) Filed: May 20, 2020

(51) Int. Cl.

| | |
|---|---|
| ***H01Q 1/28*** | (2006.01) |
| ***H01Q 21/20*** | (2006.01) |
| ***H01Q 25/04*** | (2006.01) |
| ***H01Q 9/30*** | (2006.01) |

(52) U.S. Cl.
CPC ..... *H01Q 1/28* (2013.01); *H01Q 9/30* (2013.01); *H01Q 21/205* (2013.01); *H01Q 25/04* (2013.01)

(58) Field of Classification Search
CPC ..... H01Q 21/205; H01Q 25/04; H01Q 9/30; H01Q 1/28
See application file for complete search history.

(56) References Cited

U.S. PATENT DOCUMENTS

| | | | | |
|---|---|---|---|---|
| 4,317,119 | A * | 2/1982 | Alvarez | G01S 13/933 342/455 |
| 5,552,788 | A | 9/1996 | Ryan et al. | |
| 6,223,123 | B1 | 4/2001 | Ryan et al. | |
| 10,468,758 | B1 * | 11/2019 | Ozdemir | H01Q 21/24 |
| 2012/0194386 | A1 * | 8/2012 | Mussler | H01Q 1/28 342/374 |
| 2013/0154889 | A1 * | 6/2013 | Desclos | H01Q 1/243 343/745 |
| 2019/0312607 | A1 * | 10/2019 | Korn | H04B 7/04 |

* cited by examiner

*Primary Examiner* — Awat M Salih
(74) *Attorney, Agent, or Firm* — John L. DeAngelis; Wolter, Van Dyke, Davis, PLLC

(57) ABSTRACT

An antenna system. The system includes a feed network with first input/output terminals and second output/input terminals, and antenna elements forming an array. In a first configuration: each of the second plurality of output/input terminals is connected to one of the antenna elements, the array operating according to a different radiation pattern based on which one of the first plurality of input/output terminals carries a signal into the feed network. In a second configuration: a selected antenna element is disconnected from the second plurality of output/input terminals and receives a direct signal, bypassing the feed network, and operates according to its independent radiation pattern. Also, in the second configuration each remaining antenna element is disconnected from the second plurality of output/input terminals and connected directly to a detuning network, causing these antenna elements to have a minimal effect on the independent radiation pattern of the selected antenna element.

23 Claims, 7 Drawing Sheets

METHOD AND SYSTEM FOR GENERATING AN OMNIDIRECTIONAL ANTENNA PATTERN FROM A DIRECTIONAL ANTENNA ARRAY

FIELD OF THE INVENTION

The present invention relates to a method for controlling an antenna array, and an antenna array so controlled, to produce directional and omnidirectional antenna patterns as desired in both a receiving and transmitting operational mode.

BACKGROUND OF THE INVENTION

An aircraft-mounted directional surveillance antenna provides a preferable (directional) radiation pattern for communications with other aircraft. The directional surveillance antenna on a host aircraft transmits interrogations that are received by a transponder onboard a threat aircraft. Said interrogations elicit replies from the transponder of the threat aircraft. The directionality of the transmitting directional surveillance antenna minimizes the number of threat aircraft receiving (and therefore responding) to individual interrogations from the host aircraft.

To ensure reception by the host aircraft, the threat aircraft responds to received interrogation signals through an omnidirectional antenna. The receiving host aircraft uses the directional pattern of its directional surveillance antenna to determine a direction of arrival of responses from the threat aircraft, thus providing a bearing to the threat aircraft.

The directional surveillance antenna comprises multiple antenna elements to provide the directional pattern. For example, a four-element array may be mounted with an element situated to the forward, aft, left, and right sides of the aircraft in order to provide the directional capability.

As described above, the host aircraft transmits the interrogation signal in a directional pattern and uses that directional antenna pattern to receive the response, from which the bearing to the threat aircraft can be determined. As also described above, the threat aircraft transmits its response according to an omnidirectional pattern. But, any aircraft may, at different times, operate as a host aircraft and as a threat aircraft. Typically, different antenna arrays are employed to generate the directional and the omnidirectional antenna patterns.

BRIEF DESCRIPTION OF THE DRAWINGS

The foregoing and other features of the invention will be apparent from the following more particular description of the invention, as illustrated in the accompanying drawings, in which like reference characters refer to the same elements throughout the different figures. The figures are not necessarily to scale, emphasis instead being placed upon illustrating the principles of the invention.

DETAILED DESCRIPTION OF THE INVENTION

It is desirable to combine the functions of the directional surveillance antenna with the omnidirectional transponder antenna to minimize the number of antennas mounted on an aircraft. Since the transponder replies must be transmitted according to an omnidirectional antenna pattern, it is necessary to provide a means by which a multi-element directional surveillance antenna, which transmits and receives in a directional pattern, can be switched to an omnidirectional mode for transmitting transponder replies to interrogations. Thus, the present invention teaches a technique for generating an omnidirectional radiation pattern from the directional surveillance antenna.

Before describing the methods and systems for generating an omnidirectional antenna pattern and a directional pattern from an antenna array, it should be observed that the specification describes and the drawings illustrate only those details that are pertinent to understanding the present invention without obscuring the disclosure with structural and functional details that will be apparent to those skilled in the art having the benefit of the description herein.

The following embodiments are not intended to define limits as to the structure, function or method of the invention embodiments, but only to provide exemplary constructions. The embodiments are permissive rather than mandatory and illustrative rather than exhaustive.

Figure 1:
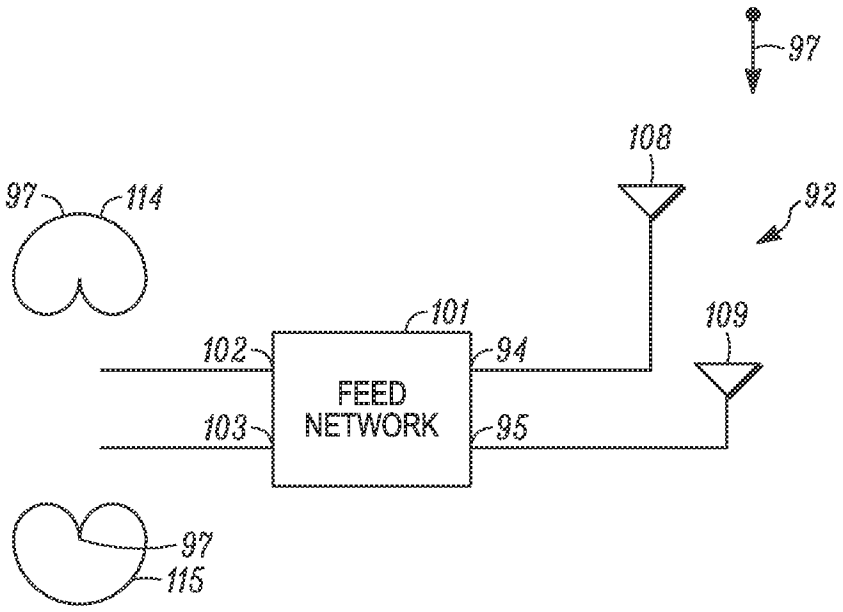
FIG. 1 (PRIOR ART)
FIG. 1 illustrates a block diagram of a prior art antenna system for producing two directional radiation patterns.

One prior art embodiment of a two-element directional antenna array 92 (referred to as a beacon antenna system in certain applications) is shown in FIG. 1. In a receive mode, a feed network 101 combines signals from the antenna elements 108 and 109 such that a signal magnitude at an RF port 102 (also referred to as a terminal) is represented by a directional cardioid pattern 114 and a signal magnitude at an RF port 103 (also referred to as a terminal) represents a directional cardioid pattern 115. As can be seen, each cardioid pattern exhibits a peak in one direction and a null 180° from the peak.

Specifically, the phase relationship of the signals at the ports 94 and 95 (also referred to as terminals and functioning as input ports when the antenna array 92 operates in a receiving mode), when processed through the feed network 101 generates signals at the ports 102 and 103 that follow the illustrated cardioid patterns 114 and 115, respectively. For example, a signal arriving at the antenna elements 108 and 109 (and input to respective ports 94 and 95) from a direction 97 produces a maximum signal magnitude at the port 102 in the direction 97. While that same signal generates a minimal signal magnitude at the port 103 in the direction 97.

The phase relationship between the signals at the ports 94 and 95 varies with the angle of arrival of the received signal. The signals at the ports 94 and 95 are operated upon by the feed network 101 to produce signal amplitudes at ports 102 and 103 that vary with the angle of arrival according to cardioid patterns 114 and 115. Analysis of the signals at the ports 102 and 103 (specifically a ratio of the two signals)

determines the angle of arrival of the received signal, and from that information the bearing to the threat aircraft is easily determined.

The spacing between the antenna elements 108 and 109 is less than a wavelength at the operating frequency. Therefore, the same signal cycle is received at each antenna element 108 and 109, but the elements receive different phase angles of the signal during a single signal cycle.

The transmit and receive patterns for the antenna array 92 are the same due to the antenna reciprocity theorem.

In the transmit mode the antenna array can generate one of two different directional patterns, either the cardioid pattern 114 or 115, when an input signal is applied to only one of the ports 102 and 103. The radiation pattern will be the cardioid pattern 114 if the input signal is applied to the RF port 102 and no signal is supplied to the RF port 103. The antenna pattern 115 is created if the signal is applied to the RF port 103 and no signal is supplied to the port 102.

The feed network 101 processes the input signal and generates an output signal at each port 94 and 95 (when the antenna array operates in the transmit mode) for driving the antenna elements 108 and 109 to produce either the radiation pattern 114 or the radiation pattern 115, depending on which input port is driven. As in the receive mode, each pattern is created by phase and amplitude relationships of the signals at the ports 94 and 95 as imparted by components within the feed network 101, for driving the antenna elements 108 and 109.

The radiation patterns 114 and 115 are, in effect, caused by a combination of the radiation pattern and coupling of the antenna elements 108 and 109. Whichever one of the RF ports 102 and 103 does not receive an input signal (when in the transmitting mode) remains connected to the system during operation. Thus, this non-driven port influences the net radiation pattern from and the coupling between the antenna elements 108 and 109.

Other patterns may be produced by applying some signal to both ports 102 and port 103, but this detail is not relevant to the present embodiment.

In one application, the antenna elements 108 and 109 are collocated (spaced apart with less that a wavelength at an operating frequency between the elements). Thus, the antenna pattern 114 produces a maximum signal in the forward direction and a null in the rearward direction (in both the transmit and receive operational modes). Conversely, the antenna pattern 115 has a maximum in the rearward direction and a null in the forward direction (in both the transmit and receive operational modes).

Figure 2:
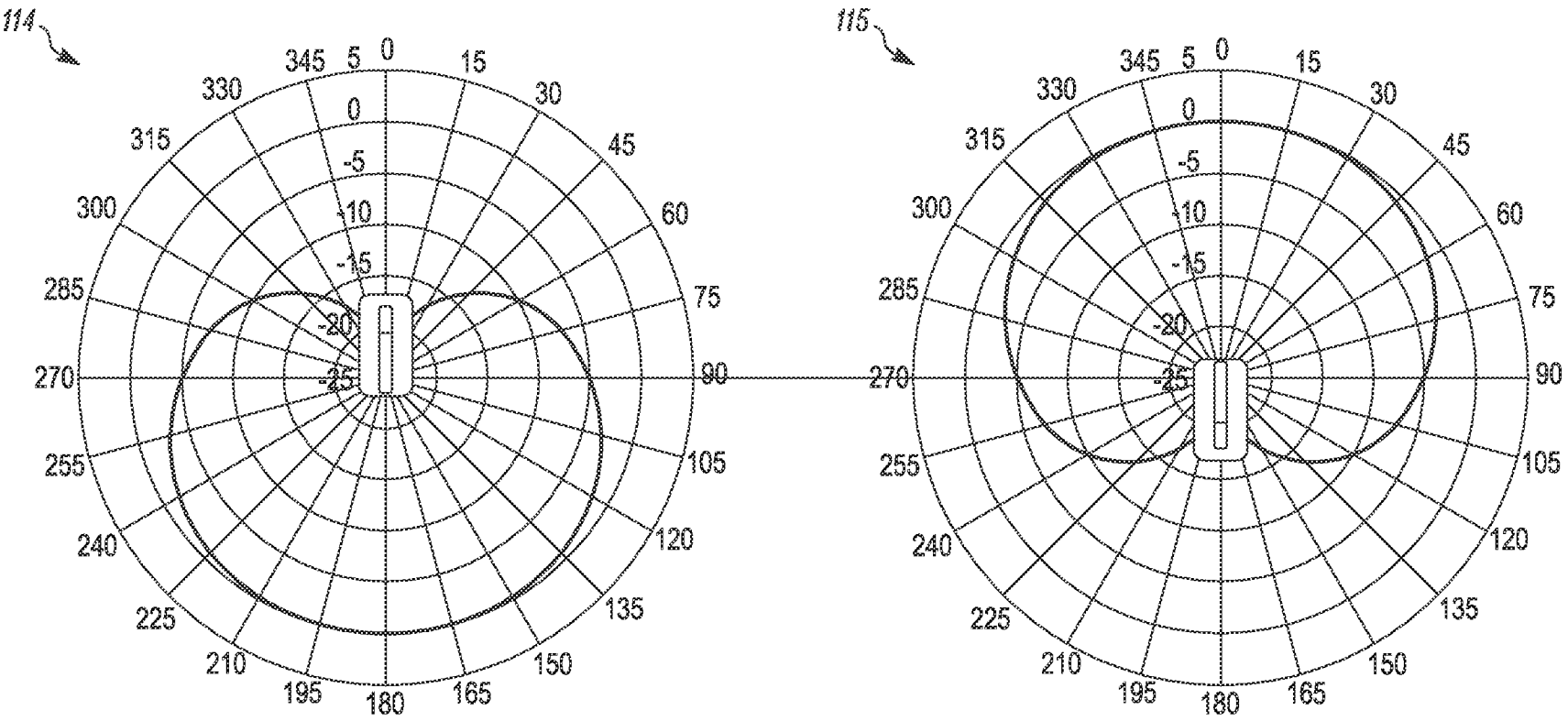
FIG. 2 illustrates radiation patterns as provided by the antenna system of FIG. 1.

The cardioid patterns 114 and 115 are illustrated in greater detail, including polar coordinates and relative magnitude numerical values in dB, in FIG. 2. In this figure, the reference value for the dB values is the gain at the circle designated 0 dB.

Figure 3:
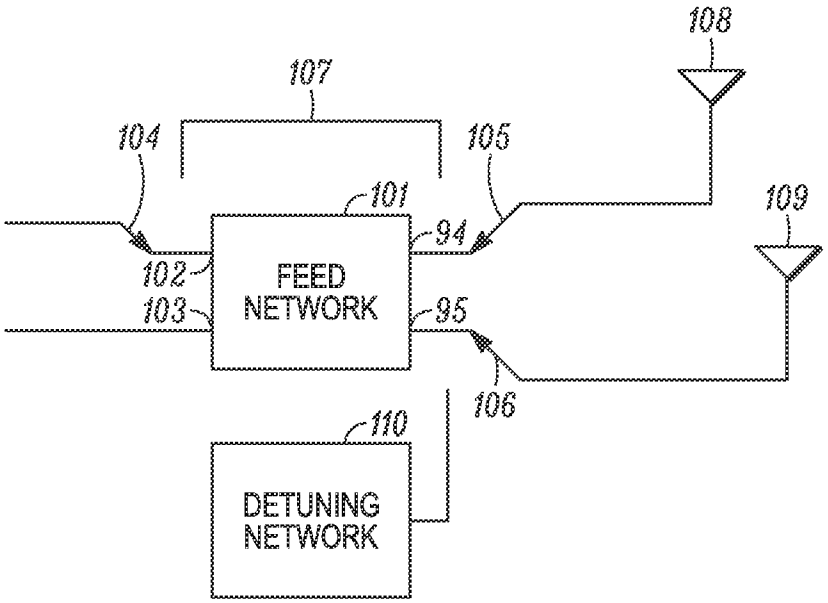
FIGS. 3 and 4 illustrate two configurations of the elements of the present invention for producing directional and omnidirectional radiation patterns.

One preferred embodiment of the current invention is shown in FIG. 3, where the antenna system of FIG. 1 is modified by inclusion of RF switches 104, 105, and 106, a bypass transmission line 107, and a detuning network 110.

With the switches 104, 105, and 106 configured as in FIG. 3, the modified antenna system operates like the antenna system of FIG. 1. The phase and amplitude relationships between the transmitted/received signals and the coupling between the antenna elements 108 and 109 results in a directional radiation pattern, i.e., the cardioid radiation pattern 114 or 115 of FIG. 2 at the terminals 102 and 103. Since these patterns are the same in both transmit and receive operations, the cardiod patterns 114 and 115 are, in effect, associated with the respective RF ports or terminals 102 and 103.

Figure 4:
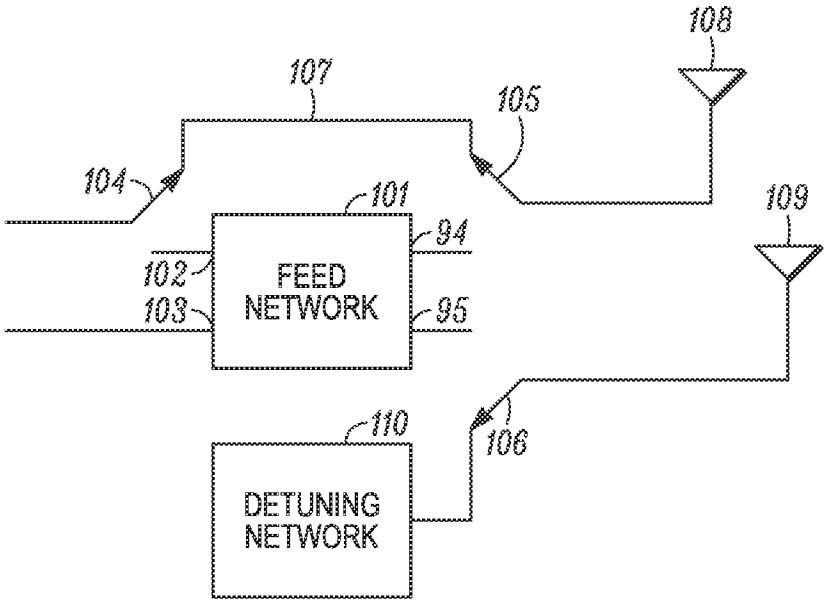

When the RF switches 104, 105, and 106 are switched to the positions shown in FIG. 4, the antenna element 108 directly receives the RF input signal (via the bypass transmission line 107) without the signal passing through the feed network 101.

In the FIG. 4 configuration, the antenna element 109 is connected to a detuning network 110 and is electrically removed from the array at the operating frequencies of the antenna system. The detuning network 110 electrically detunes the resonant frequency of the antenna element 109, i.e., electrically tuning the element 109 to a different frequency. The detuning network also adjusts the impedance of the antenna element 109 such that mutual coupling to antenna element 108 is minimized.

These actions decouple the two antenna elements and minimize the currents induced on the antenna element 109 by the antenna element 108. A preferred decoupling network is a function of the antenna element geometry and spacing between the elements. An optimal solution for the detuning network is best derived via antenna modeling that includes all antenna element and array details, as well as objects in the proximate environment, i.e., radomes and other electrical, conductive, and dielectric components.

In sum, when connected to the detuning network, the antenna element 109 imposes minimal effect on operation of the antenna element 108, such that the element 108 operates essentially as in isolation, with a radiation pattern determined according to the physical and electrical characteristics of the antenna. When operating in isolation the radiation pattern may also be referred to as an independent radiation pattern.

Thus, when the antenna element 108 is a monopole antenna operating in isolation, the antenna element 108 exhibits an omnidirectional radiation pattern. Other antenna element types may be utilized in lieu of a monopole antenna, as required by the requirements of a specific application.

Note that feeding the RF signal to the antenna element 108, with the element 109 open-circuited or short-circuited, as done according to the prior art, generates an antenna pattern at the antenna element 108 that exhibits significant asymmetry due to coupling between the two antenna elements 108 and 109. This coupling is minimizes according to the present invention.

Connecting the unused or inactive antenna element 109 to the de-tuning network 110, as taught by the present invention, and appropriately configuring the detuning network 110, minimizes coupling between the two antenna elements. The result is a significant reduction in azimuth pattern asymmetry for the radiation pattern of the active antenna element 108. By optimizing the de-tuning network (i.e., selecting appropriate inductive and capacitive component values, which is most easily accomplished by simulating operation of the antenna elements 108 and 109) it is possible to reduce the pattern asymmetry to almost zero, thus enabling the antenna 108 to transmit according to an omnidirectional pattern when the element 108 comprises a monopole antenna.

Thus, the present invention adds a third pattern (the omnidirectional pattern in addition to the two directional patterns 114 and 115 of the antennas 108 and 109) to the existing antenna array without requiring additional antenna elements or, in an aircraft surveillance system application, without requiring additional antenna mounting space on the aircraft.

Returning to FIG. 3, according to another embodiment, the switch 104 is moved to the RF port 103, the switch 105 is moved to the antenna element 109. In this embodiment, the detuning network 110 is switchably connected to the antenna element 108 and a signal source (for operation in the transmit mode) is switchably connected directly to the antenna element 109 or to the RF port 103 of the feed network 101. Conversely, in a receive mode, the received signal appears at the port 103. In this embodiment the antenna element 108 is the inactive element and radiation propagates from the antenna element 109 without interference from the element 108.

Figure 5:
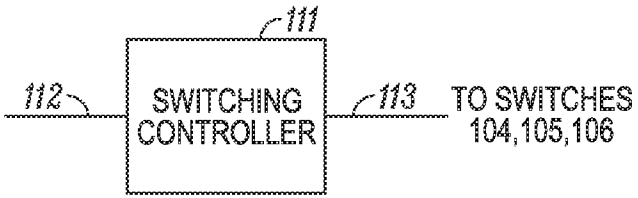
FIG. 5 illustrates a switch controller for controlling the configuration of switches in FIGS. 3 and 4.

FIG. 5 illustrates a switch controller 111 for receiving switch commands 112 and generating switch control signals 113 for controlling each of the switches 104, 105, and 106 into the configurations illustrated in FIG. 3 or the configurations illustrated in FIG. 4, as desired.

The embodiment described above utilizes a two-element array of antenna elements 108 and 109 (which in one embodiment and when operating in isolation are both individually omnidirectional) and controls the signals input to each antenna element to generate a desired pattern from the antenna array. The invention, however, is not limited to two-element antenna arrays.

Multi-element antenna arrays can utilize the same technique of detuning one or more unexcited elements to electrically remove this element(s) from influencing the radiation pattern of the active element(s). In such an embodiment, the antenna pattern of the active element(s) can be modified to reduce pattern sidelobes, improve gain, improve radiation pattern characteristics, and/or achieve a radiation pattern that is nearly identical to the radiation pattern of the excited element(s) when operating in isolation. Thus, the concepts of the present invention can be extended beyond only generating omnidirectional antenna patterns from directional antenna arrays (as described in conjunction with FIGS. 3 and 4).

Figure 6:
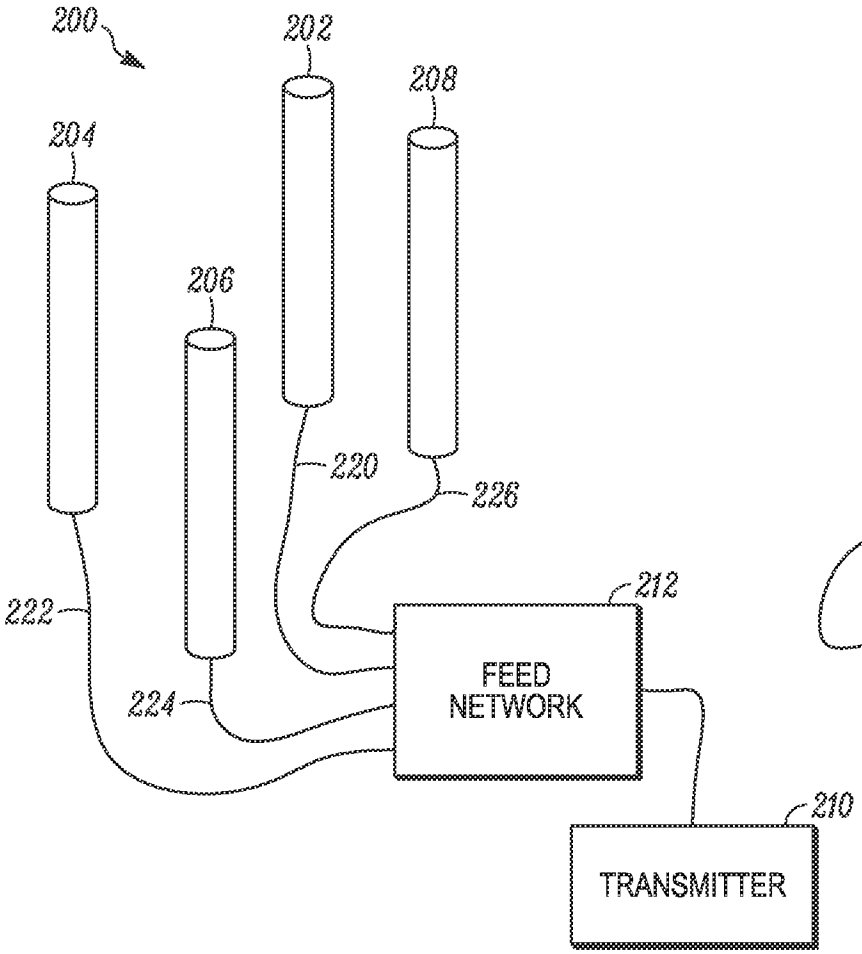

FIG. 6 illustrates one such embodiment where an antenna array 200 comprises antenna elements 202, 204, 206, and 208. A transmitter 210 supplies a signal to be transmitted to a feed network 212, which controls the phase of each signal 220, 222, 224, and 226 input to respective antenna elements 202, 204, 206 and 208, thereby producing a desired or first radiation pattern from the antenna array 200. In a conventional embodiment, the feed network 212 is not located within the antenna system, but is instead located in an antenna system controller that produces a radio frequency signal, suitably phase shifted, and input to each antenna element 202, 204, 206, and 208 so that the array 200 provides a desired or first radiation pattern.

In addition to achieving the desired radiation pattern for the array 200, the amplitude and phase of one or more of the signals 220, 222, 224, and 226 can be controlled to reduce antenna sidelobes in a desired direction or to increase the antenna gain in a desired direction.

Figure 7:
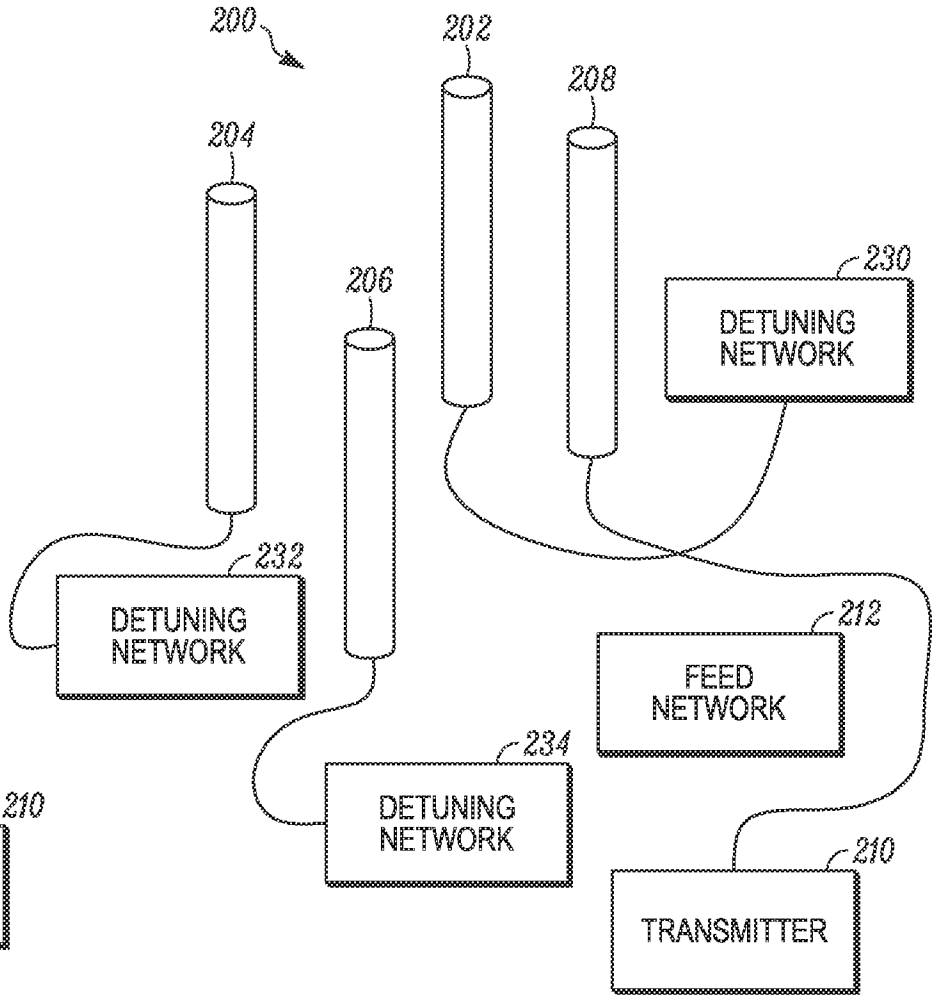
FIGS. 6 and 7 illustrate application of the teachings of the present invention to an antenna array comprising four elements.

In the FIG. 7 configuration of the array 200, the feed network 212 is disconnected from each of the antenna elements and the element 208 is connected directly to the transmitter 210. The antenna elements 202, 204, and 206 are connected to a respective detuning network 230, 232, and 234 for detuning the three elements to negligibly influence operation of the element 208. In this configuration, the radiation pattern from the array 200 is essentially the radiation pattern for the antenna element 208 operating in isolation (also referred to as a second radiation pattern different from the first radiation pattern when all the antenna elements are active as in FIG. 6).

Although described above and illustrated in the context of transmitting operation, the array 200 functions similarly for operation in a receiving mode, with the feed network and transmitter replaced by suitable receiving components.

Figure 8:
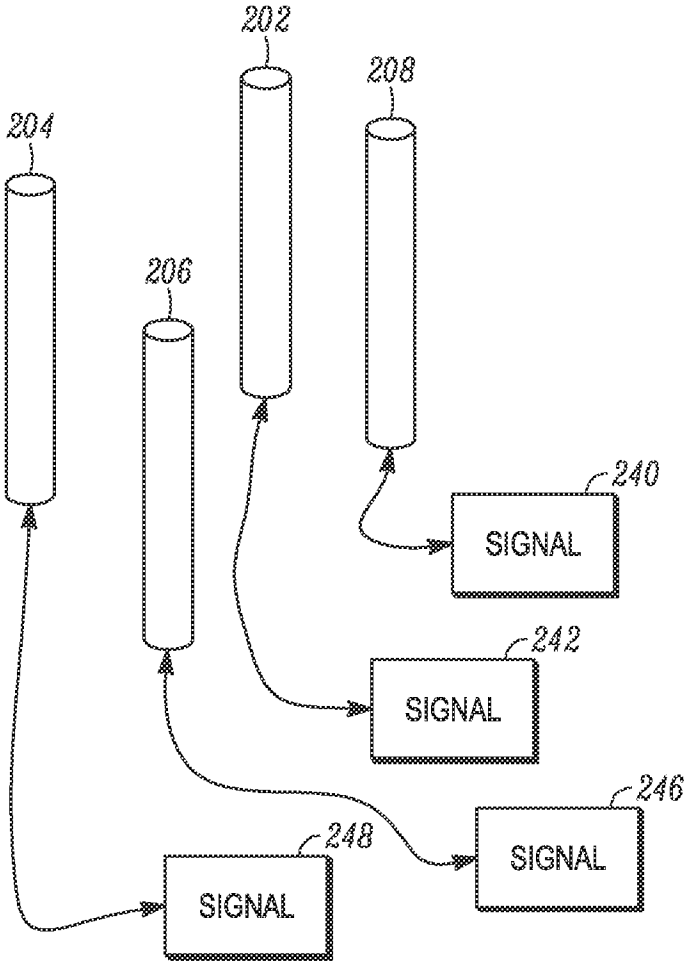

Additionally, although the antenna elements 202, 204, 206, and 208 are illustrated in FIG. 6 as each receiving a signal from the feed network 212, in a more general embodiment the feed network 212 is replaced by individual signal sources that feed each of the antenna elements. See FIG. 8, for example, where signal sources 240, 242, 246, and 248 feed respective antenna elements 208, 202, 206, and 204.

Figure 9:
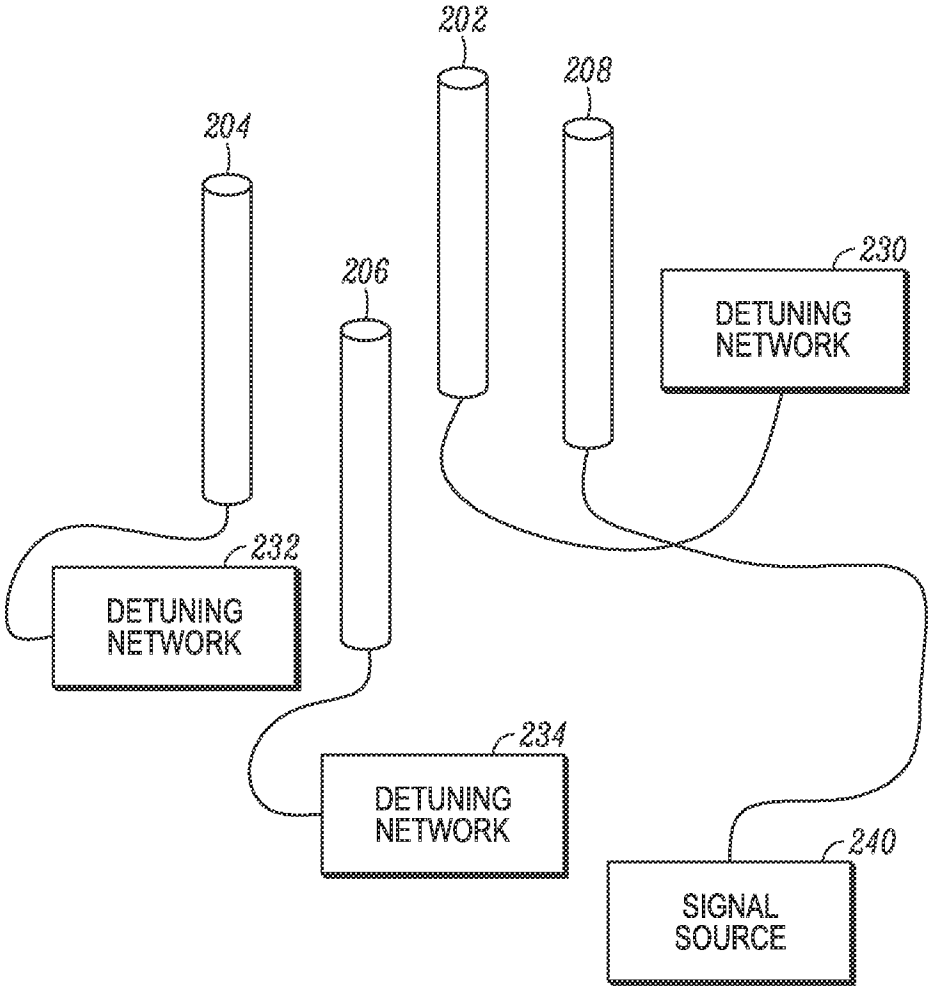
FIGS. 8 and 9 illustrate an alternative embodiment for a four-element antenna array.

In the alternative configuration of FIG. 9, each signal source is replaced by a detuning network, and the signal source 240 feeds the antenna element 208.

Figure 10:
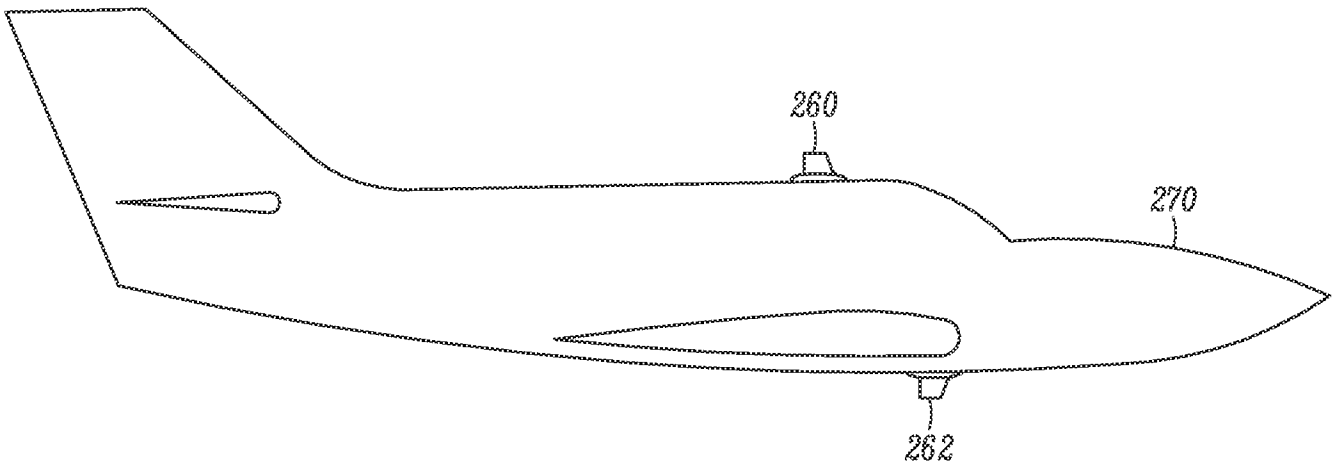
FIG. 10 illustrates the antenna array of the present invention mounted on an aircraft.

FIG. 10 illustrates antenna arrays 260 and 262 mounted on an aircraft 270. Each antenna array encloses two antenna elements (not shown) that operate according to the teachings of the invention.

Certain of the embodiments have been described herein as operating in a receiving mode and other embodiments have been described as operating in a transmitting mode. According to the antenna reciprocity theorem the receive and transmit properties (gain, radiation pattern, etc.) for any antenna are identical and therefore the described embodiments can operate in either mode.

While the invention has been described with reference to preferred embodiments, it will be understood by those skilled in the art that various changes may be made and equivalent elements may be substituted for elements thereof without departing from the scope of the present invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna system comprising:

a feed network comprising a first plurality of signal terminals and a second plurality of signal terminals;

a plurality of antenna elements comprising an antenna array;

a plurality of detuning networks;

according to a first configuration:

each one of the second plurality of signal terminals connected to one of the plurality of antenna elements;

the antenna array operating according to a different antenna array radiation pattern based on which of the first plurality of signal terminals is carrying a signal;

according to a second configuration:

one of the first plurality of signal terminals disconnected from the feed network;

a selected antenna element from among the plurality of antenna elements disconnected from one of the second plurality of signal terminals, and directly connected to the one of the first plurality of signal terminals disconnected from the feed network, and operating according to the antenna element's independent radiation pattern; and each remaining antenna element from among the plurality of antenna elements disconnected from the second plurality of signal terminals and connected to one of the plurality of detuning networks for altering operational characteristics of a connected antenna element, such that each remaining antenna element has a minimal effect on the independent radiation pattern of the selected antenna element.

2. The antenna system of claim 1, wherein the plurality of antenna elements comprises a first and a second antenna element, and wherein the first plurality of signal terminals comprises a first and a second terminal, and wherein a radiation pattern associated with the first terminal comprises a first cardiod pattern with maximum gain in a first direction and a radiation pattern associated with the second terminal comprises a second cardiod pattern with maximum gain in a second direction, the first direction 180 degrees in an azimuth plane from the second direction.

3. The antenna system of claim 2, wherein in a transmit mode a signal input to the first terminal causes the antenna array to transmit according to the first cardiod pattern and a signal input to the second terminal causes the antenna array to transmit according to the second cardiod pattern, and wherein in a receive mode signals at the first terminal are received by the antenna array according to the first cardiod pattern and signals at the second terminal are received by the antenna array according to the second cardiod pattern.

4. The antenna system of claim 1, wherein the feed network supplies signals to or receives signals from each one of the plurality of antenna elements through the second plurality of terminals, and effects one or both of magnitude and phase characteristics to signals input to the feed network, such that each one of the first plurality of terminals is associated with a different radiation pattern.

5. The antenna system of claim 4, wherein the feed network comprises one or more of a resistor, a capacitor, an inductor, or a transmission line for effecting one or both of magnitude and phase characteristics.

6. The antenna system of claim 1, wherein each one of the first plurality of terminals is associated with a directional radiation pattern.

7. The antenna system of claim 1, wherein the independent radiation pattern according to the second configuration comprises an omnidirectional radiation pattern.

8. The antenna system of claim 1, wherein a spacing between each one of the plurality of antenna elements is less than a wavelength at an operating frequency of the antenna system.

9. The antenna system of claim 1, wherein the detuning network comprises one or more circuit elements for imparting one or more of magnitude, frequency, or phase characteristics to each remaining antenna element, wherein the one or more circuit elements comprise one or more of a resistor, a capacitor, an inductor, or a transmission line.

10. The antenna system of claim 1, wherein the antenna array radiation pattern in the first configuration is due to interactions among signals carried by the plurality of antenna elements and operation of the feed network.

11. An antenna array for providing a plurality of radiation patterns, the antenna array comprising:

first and second antenna elements;

according to a first configuration:

a feed network comprising first and second terminals connected to the respective first and second antenna elements, and further comprising third and fourth terminals;

the first and second antenna elements for operating according to a first radiation pattern associated with a signal carried on the third terminal, the first and second antenna elements for operating according to a second radiation pattern associated with a signal carried on the fourth terminal;

according to a second configuration:

the first and second terminals of the feed network disconnected from the first and second antenna elements;

the second antenna element connected to a detuning network for altering operational characteristics of the second antenna element such that the second antenna element has a minimal effect on operation of the first antenna element, such that the first antenna element operates in isolation and thereby exhibits a third radiation pattern in both transmitting and receiving operation.

12. The antenna array of claim 11 wherein the feed network comprises one or more circuit elements for imparting one or both magnitude, frequency, and phase characteristics to signals input thereto such that according to the first configuration the first and second radiation patterns each comprise a directional radiation pattern.

13. The antenna array of claim 12 wherein the one or more circuit elements comprise one or more of a resistor, a capacitor, an inductor, or a transmission line.

14. The antenna array of claim 11 wherein the first radiation pattern is characterized by a maximum gain in a first direction and a minimum gain in a second direction and the second radiation pattern is characterized by a minimum gain in the first direction and a maximum gain in the second direction, the first direction opposite the second direction.

15. The antenna array of claim 11 wherein the first and second radiation patterns each comprise a directional radiation pattern and the third radiation pattern comprises an omnidirectional radiation pattern.

16. The antenna array of claim 15 wherein the first and second radiation patterns each comprise a cardiod radiation pattern.

17. An aircraft comprising a first antenna system according to claim 11 with the antenna array mounted on a top surface of the aircraft with a distance between the first and second antenna elements less than a wavelength at an operating frequency, and a second antenna system according to claim 11 with the antenna array mounted on a bottom surface of the aircraft with a distance between the first and second antenna elements less than a wavelength at an operating frequency.

18. The antenna array of claim 11 wherein a spacing between the first and second antenna elements is less than a wavelength at an operating frequency.

19. The antenna array of claim 11 further comprising:

a conductive path comprising fifth and sixth terminals;

first, second, and third switches;

according to the first configuration:

by operation of the first switch, the third terminal of the feed network connected to a signal path for carrying a signal associated with the first radiation pattern;

by operation of the second switch, the first antenna element connected to the first terminal of the feed network;

by operation of the third switch, the second antenna element connected to the second terminal of the feed network;

according to the second configuration:

by operation of the first switch, the signal path connected to the fifth terminal of the conductive path;

by operation of the second switch, the sixth terminal of the conductive path connected to the first antenna element; and by operation of the third switch, the second antenna element connected to the detuning network.

20. The antenna array of claim 19 further comprising a switch controller for controlling a condition of the first, second, and third switches according to the first configuration or the second configuration.

21. An antenna array for providing at least two antenna array radiation patterns, the antenna array comprising:

a plurality of antenna elements;

a plurality of detuning networks;

according to a first configuration:

the plurality of antenna elements presenting a first antenna array radiation pattern;

according to a second configuration:

a selected antenna element from among the plurality of antenna elements presenting a second antenna element radiation pattern; and each remaining antenna element from the plurality of antenna elements connected to one of the plurality of detuning networks, wherein the detuning networks alter operational characteristics of each remaining antenna element such that the remaining antenna elements have a minimal effect on operation of the selected antenna element, such that the selected antenna element radiation pattern comprises the radiation pattern the selected antenna element presents when operating in isolation.

22. The antenna array of claim 21 wherein each one of the plurality of detuning networks comprises one or more circuit elements for imparting one or both of magnitude and phase characteristics that alter the operational characteristics of each remaining antenna element.

23. The antenna array of claim 22 wherein the one or more circuit elements comprise a resistor, a capacitor, an inductor, or a transmission line.

* * * * *